US006391061B1

(12) United States Patent
Hortel et al.

(10) Patent No.: US 6,391,061 B1
(45) **Date of Patent: *May 21, 2002**

(54) CARPET STAIN REMOVAL PRODUCT WHICH USES SONIC OR ULTRASONIC WAVES

(75) Inventors: Thomas Charles Hortel, Cincinnati; Nagabhusan Senapati, Columbus, both of OH (US)

(73) Assignee: Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/622,378

(22) PCT Filed: Feb. 19, 1999

(86) PCT No.: PCT/US99/03584

§ 371 Date: Aug. 16, 2000

§ 102(e) Date: Aug. 16, 2000

(87) PCT Pub. No.: WO99/42553

PCT Pub. Date: Aug. 26, 1999

Related U.S. Application Data

(60) Provisional application No. 60/075,438, filed on Feb. 20, 1998.

(51) Int. Cl.[7] ..... C11D 3/43; A47L 25/02

(52) U.S. Cl. ..... 8/137.5; 510/278; 510/280; 510/432; 510/283; 510/406; 510/439; 8/137.5

(58) Field of Search ..... 510/278, 280, 510/432, 283, 406, 439; 8/137.5; 134/32

(56) References Cited

U.S. PATENT DOCUMENTS 4,069,541 A * 1/1978 Williams et al. ..... 15/321

FOREIGN PATENT DOCUMENTS

| | | | |
|---|---|---|---|
| JP | 61-249500 | 11/1986 | |
| WO | WO 97/26821 | 7/1997 | |
| WO | 97/29178 | * 8/1997 | ..... 3/20 |

* cited by examiner

*Primary Examiner*—Mark Kopec
*Assistant Examiner*—Eisa Elhilo
(74) *Attorney, Agent, or Firm*—C. Brant Cook; Kim W. Zerby; Steve W. Miller

(57) ABSTRACT

A carpet stain removal product and process are disclosed. The product includes a liquid cleaning composition (18) which contains water, an organic solvent and a surfactant, an absorbent stain receiver, and a sonic or ultrasonic wave generating source (10) for imparting sonic or ultrasonic waves onto stains (14) on textiles (16). The sonic or ultrasonic wave source is, for example, a hand-held, pen-shaped device with a directed point to focus the sonic or ultrasonic waves at the stain to be removed.

12 Claims, 1 Drawing Sheet

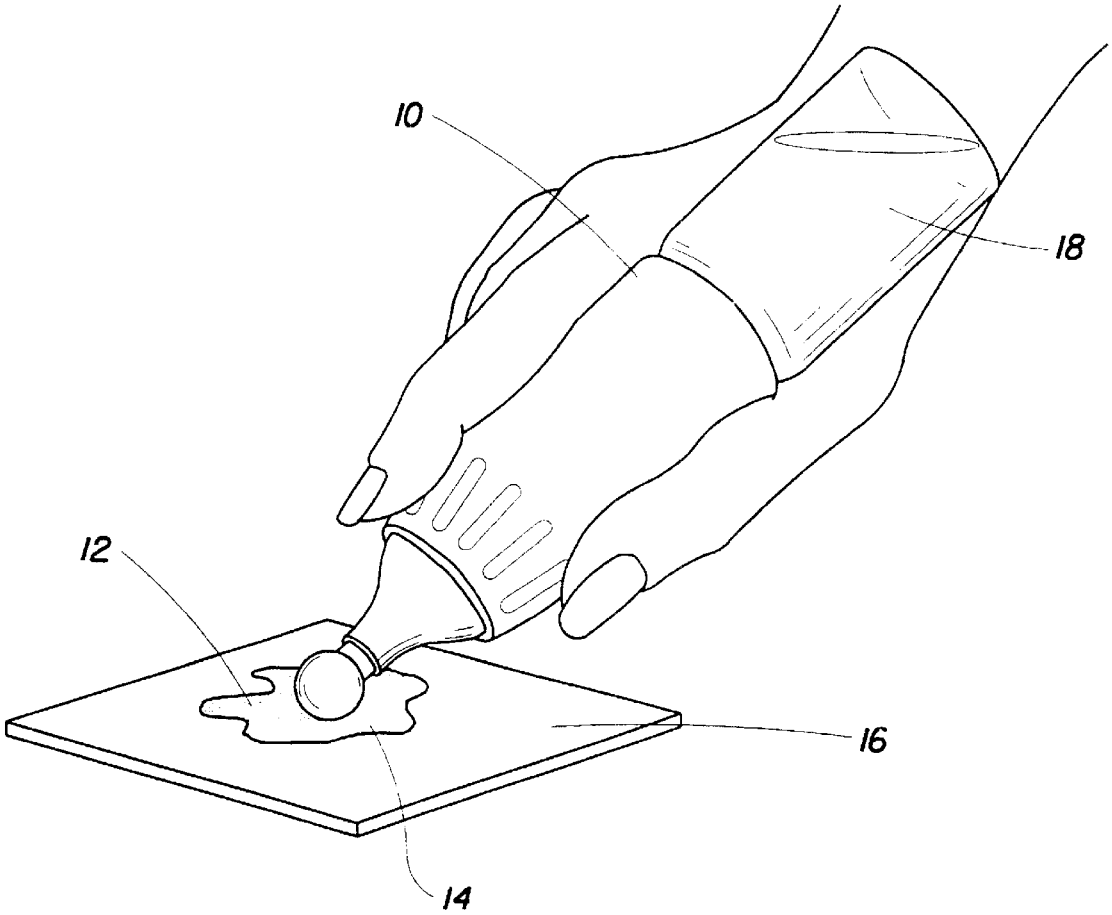
10
18
12
16
14

CARPET STAIN REMOVAL PRODUCT WHICH USES SONIC OR ULTRASONIC WAVES

This application is a 371 of PCT/US99/03584 filed Feb. 19,1999 which claims benefit of Provisional No. 60/075,438 filed Feb. 20,1998.

FIELD OF THE INVENTION

The present invention generally relates to compositions, product kits, and processes for removing stains or spots from carpeting or upholstery using sonic or ultrasonic waves.

BACKGROUND OF THE INVENTION

Typical carpet cleaning and refreshment products and processes are used to clean the entire carpet or upholstery. However, in some circumstances the user may wish only to clean localized areas of carpeting or upholstery. Alternatively, the user may wish to spot-clean localized areas of stain before subjecting the entire carpet or upholstery to an overall cleaning operation.

One problem associated with spot cleaning operations is the risk of damaging the substrate which needs stain removal. Thus, when brisk brushing is used during the operation, the resulting shear forces can disrupt and abrade carpeting, thereby leading to a premature worn appearance. Dyes may be discolored or partly removed in the spot-cleaned area. In some instances, the spot cleaning, itself, may leave "rings" or unsightly residues on the carpet or upholstery. Various means and special implements for avoiding or minimizing such problems are available to professional cleaners. However, for in-home use by relatively unskilled operators, there is a continuing search for simple, safe, yet effective methods for spot-cleaning carpeting and upholstery. These problems also occur when cleaning entire carpets and the like in that excessive brushing and rubbing can abrade carpeting giving the entire cleaned area a worn appearance and/or render residual cleaning ingredients visible.

Accordingly, there remains a need in the art for a product and process for removing stains from carpeting and upholstery without causing undesirable wear and tear on the cleaned carpet, and which minimizes the appearance of residue.

BACKGROUND ART

Cleaning/pre-spotting compositions and methods are also disclosed, for example, in U.S. Pat. Nos. 5,102,573; 5,041,230; 4,909,962; 4,115,061; 4,886,615; 4,139,475; 4,849,257; 5,112,358; 4,659,496; 4,806,254; 5,213,624; 4,130,392; and 4,395,261. U.S. Pat. No. 4,692,277 discloses the use of 1,2-octanediol in liquid cleaners.

SUMMARY OF THE INVENTION

The invention meets the needs identified above by providing a carpet stain removal product and process which can be localized for small stains or can be used to clean large areas of carpeting and the like. In essence, the product includes a liquid cleaning composition which contains water, an organic solvent and a surfactant, an absorbent stain receiver, and a sonic or ultrasonic wave generating source for imparting sonic or ultrasonic waves to stains on textiles. The sonic or ultrasonic wave source is, for example, a hand-held, pen-shaped device with a directed point to focus the sonic or ultrasonic waves at the stain to be removed. The invention also provides a process for removing stains from carpeting. This process involves the steps of applying an effective amount of a liquid cleaning composition to the stain, imparting sonic or ultrasonic waves to the treated stain, and contacting the stain with an absorbent stain receiver having an absorbent material while applying pressure so as to absorb the stain into the absorbent material of the absorbent stain receiver. Variations of the aforedescribed stain product and process are also described herein and contemplated by the invention.

As used herein, the phrase "sonic or ultrasonic waves" means mechanical pressure or stress waves which can propagate through any material media, wherein the frequency spectra of these waves can vary from a few cycles/second (Hz) to a few billion Hz; the word "sonic" refers to the frequency range of sound waves (for human hearing) which is 20 Hz to 20,000 Hz. Pressure waves of frequency above human hearing are referred to as ultrasonic. The sono-mechanical effects of stress waves for enhancing stain removal is not related to human hearing and therefore the boundary between sonic and ultrasonic is irrelevant for this invention.

All percentages, ratios and proportions herein are by weight, unless otherwise specified. All documents cited are, in relevant part, incorporated herein by reference.

BRIEF DESCRIPTION OF THE DRAWING

The FIGURE is a perspective view of a hand-held, pen-shaped ultrasonic device, which is used in the invention to impart ultrasonic waves onto a stain.

DETAILED DESCRIPTION OF THE INVENTION

The invention encompasses a stain removal product essentially including a liquid cleaning composition, an absorbent stain receiver and a sonic or ultrasonic wave source. By using this product, stains from carpeting can be removed without the use of excessive force, rubbing, pressure or other manipulation which causes wear and tear on the stained material. In doing so, the user does not need to impart such manual energy to remove the stain, thereby adding to the convenience of the user. The invention also encompasses processes by which such stains are removed, either from localized regions or from the entire article to be cleaned.

In a preferred embodiment, the liquid cleaning composition includes water, an organic solvent and a surfactant. Preferred levels and specific components are detailed hereinafter. The preferred solvent is butoxy propoxy propanol ("BPP"), and the preferred surfactant is selected from the group consisting of anionic surfactants, nonionic surfactants, cationic surfactants and mixtures thereof. The absorbent stain receiver includes an absorbent material which, in essence, lifts or sucks the loosened stain from the material after the liquid cleaning composition has been applied and subjected to ultrasonic waves. The most preferred absorbent material is a Functional Absorbent Material ("FAM") in the form of a foam. Also, the absorbent material can be selected from the group consisting of comminuted wood pulp, creped cellulose wadding, hydrogel-forming polymer gelling agents, creped tissues, creped nonwovens containing fibers comprised of absorbent polymers, modified cross-linked cellulose fibers, capillary channel fibers, absorbent foams, thermally bonded airlaid materials, absorbent sponges, synthetic staple fibers, polymeric fibers, peat moss, and combinations thereof.

According to the invention, the sonic or ultrasonic wave generating source is used to impart sonic or ultrasonic waves onto the stain to loosen the stain from the stained carpeting or upholstery. This eliminates the need for rubbing, scrubbing, or the like to otherwise loosen the stain in combination with the cleaning composition. A preferred sonic or ultrasonic source is depicted in the FIGURE and is a pen-shaped, hand-held vibrational sonic or ultrasonic device 10 ("sonic pen") with a vibrating, smooth (e.g., spherical) sonic horn or tip at one distal end 12 of the device 10. The stain 14 on a portion of carpeting 16 has the cleaning composition applied to it and then is subjected to sonic or ultrasonic waves using the device 10. Also within the scope of the invention are devices containing sonic or ultrasonic sources that are much larger (not shown) and/or have additional sonic or ultrasonic wave outputs so as to facilitate treating large areas of carpeting covering entire rooms, hallways, and the like.

In one mode of operation, the liquid cleaning composition 18 and the sonic or ultrasonic source are contained together in the device 10 as shown in the FIGURE such that controlled dispensing of the liquid cleaning composition 18 can be applied to the stain 14 while concurrently imparting ultrasonic waves to it. In this way, the user does not need to apply the cleaning composition separately and dosing of the composition to the stain can be controlled to prevent any decrease in performance as a result of under-dosing the composition or damage to the stained carpet or upholstery resulting from over-dosing of the composition.

The stain removal product preferably includes instructions for using the product which comprises the steps of: applying an effective amount of the liquid cleaning composition to the stain; imparting sonic or ultrasonic waves to the stain using the sonic or ultrasonic source; and contacting the absorbent stain receiver with the stain while applying pressure so as to absorb the stain into the absorbent material of the absorbent stain receiver. The phrase "effective amount" means an amount of the composition sufficient to saturate the stain, and will typically include applying from about 0.5 ml to about 3 ml of the composition for a small stain (e.g., less than 1 cm in diameter). This amount can vary dramatically if the stained area is very large, for example, on a large area of carpeting in which case much more of the composition will be needed to saturate the stained area. It is preferable for the stain to be thoroughly saturated with the cleaning composition such that the soils that have been dislodged by the sonic or ultrasonic waves can be effectively suspended in the composition. In this way, the absorbent stain receiver can absorb all of the soils embodied in the stain via absorption of the cleaning composition.

In another process of using the stain removal product, the stain removal may include instructions for using the product comprising the steps of: using the device to apply an effective amount of the liquid cleaning composition to the stain concurrently with sonic or ultrasonic waves from the sonic or ultrasonic source contained in the device; and contacting the absorbent stain receiver with the stain while applying pressure so as to absorb the stain into the absorbent material of the absorbent stain receiver. The pressure is applied by the user's hand in the z direction (i.e., normal to the plane of the fabric being cleaned) and preferably not in the x and/or y directions so as not to cause wear and tear on the material that has been stained. As shown in the FIGURE, the process is facilitated by using a device 10 such that the composition and the sonic or ultrasonic waves are applied simultaneously to permit controlled dispensing of the liquid cleaning composition to the stain.

Another embodiment of the invention contains the absorbent stain receiver having an absorbent material which is imbibed with a liquid cleaning composition including water, an organic solvent and a surfactant, and a sonic or ultrasonic wave generating source for imparting sonic or ultrasonic waves onto stains on textiles. In this product form, the preferred absorbent material is a Functional Absorbent Material ("FAM") foam. The process of using this product entails contacting an absorbent stain receiver with the stain, wherein the absorbent material is imbibed with a liquid cleaning composition including water, an organic solvent and a surfactant. The stain receiver is applied on top of the stain. Thereafter, pressure is applied by forcing the sonic or ultrasonic device directly against the absorbent stain such that the liquid cleaning composition is forced from the absorbent material into the stain. Sonic or ultrasonic waves from a wave generating source is imparted to the stain, and in both stain receiver positions, the applied pressure is relieved such that the liquid cleaning composition and the stain are absorbed back into the absorbent material in the absorbent stain receiver. This technique allows the cleaning treatment to be localized, thereby minimizing treatment of non-stained areas of carpeting which unnecessarily can increase wear and tear on the stained carpeting.

In a preferred mode of operation, the pressure and sonic or ultrasonic wave application steps are conducted using a pen-shaped, hand-held vibrational sonic or ultrasonic device with a vibrating smooth, rounded (e.g., spherical) sonic horn or tip at one distal end of the device which can be pressed in the z direction against the stain and simultaneously impart sonic or ultrasonic waves to the stain. The sonic or ultrasonic device can be used directly against the stain with the absorbent stain receiver positioned underneath the stained textile so that the liquid cleaning composition is dawn from the opposition side of the sonic or ultrasonic waves as pressure is applied. Alternatively, the absorbent stain receiver can be contacted with the stain using the sonic or ultrasonic device which is pressed against the stain receiver, which in turn, presses against the stain drawing liquid cleaning composition into the stain. The sonic or ultrasonic waves penetrate through the stain receiver and to the stain, after which the sonic or ultrasonic device is lifted away releasing the pressure such that both the stain and liquid cleaning composition are wicked or absorbed back into the stain receiver.

In an especially preferred embodiment of the invention, the liquid cleaning composition includes: from about 0.1% to about 10% by weight of an organic solvent; from about 0% to about 7% by weight of hydrogen peroxide; from about 0% to about 3% by weight of a peroxide-stabilizing amount of a chelating agent; from about 0.05% to about 2% by weight of a detersive surfactant; and the balance water and other optional ingredients. Other ingredients and levels may be used in accordance with the invention and are detailed hereinafter.

Sonic or Ultrasonic Wave Source—A variety of sonic or ultrasonic sources can be used in the invention including, but not limited to, sonic cleaning baths typically used to clean jewelry and sonic toothbrushes for cleaning teeth. One suitable sonic or ultrasonic source is a modified sonic toothbrush in which the head of the sonic toothbrush is replaced with a smooth chrome spherical tip as shown in the FIGURE. Other tip modifications can be made without departing from the scope of the invention so long as the tip structure does not have a structure which can abrade the article with which it comes into contact. Such a sonic toothbrush is readily commercially available, for example, from Teldyne WaterPik, Inc., model SR-400R. Typically, from about 1 watt to about 5 watts, more typically from about 2 watts to about 3 watts, of ultrasonic amplitude is sufficient to treat carpeting. A typical ultrasonic device for use herein will have a sonic frequency of about 250 Hz and deliver from about 2 to about 3 watts of power.

Typical treatment times range from about 1 second to about 5 minutes, more typically from about 20 seconds to about 2 minutes, and most typically from about 30 seconds to 1 minute, although treatment times will vary with the severity of the stain. The sonic or ultrasonic source device can be a vibrational sonic or ultrasonic generator, a torsional sonic or ultrasonic wave generator, or an axial sonic or ultrasonic generator in that it is the shock waves generated by these sonic or ultrasonic sources that does the actual cleaning or loosening of the stain on the textile regardless of the mechanism by which the sonic or ultrasonic shock waves are generated. The sonic or ultrasonic wave generating device can be battery operated or a plug-in type.

Liquid Cleaning Compositions—The user of the present product or process can be provided with various liquid cleaning compositions to use as spot or stain removers. One problem associated with known carpet pre-spotting compositions is their tendency to leave visible residues on carpet surfaces. Such residues are problematic and are preferably to be avoided herein since the invention does not involve conventional immersion or rinse steps. Accordingly, the liquid cleaning compositions herein should, most preferably, be substantially free of various polyacrylate-based emulsifiers, polymeric anti-static agents, inorganic builder salts and other residue-forming materials, except at low levels of about 0.1%–0.3%, and preferably 0%, of the final compositions. Stated otherwise the compositions herein should be formulated so as to leave substantially no visible residue on materials being treated according to the practice of this invention.

Accordingly, in a preferred aspect of this invention there are provided cleaning compositions which are substantially free of materials which leave visible residues on the treated fabrics. This necessarily means that the preferred liquid compositions are formulated to contain the highest level of volatile materials possible, preferably water, typically about 95%, preferably about 97.7%, a cleaning solvent such as BPP at a low, but effective, level, typically about 0.1% to about 10%, preferably about 2%, and surfactant at levels of about 0.1 to about 0.7%. Advantageously, when thus formulated such compositions exist as aqueous solutions rather than as suspensions or emulsions. Thus, such compositions do not require use of additional emulsifiers, thickening agents, suspending agents, and the like, all of which can contribute to the formation of undesirable visible residues on the carpet.

Indeed, as an overall proposition, any of the chemical compositions which are used to provide the pre-spotting function herein comprise ingredients which are safe and effective for their intended use, and, as noted above, preferably do not leave unacceptable amounts of visible residues on carpeting. While conventional laundry detergents are typically formulated to provide good cleaning on cotton and cotton/polyester blend fabrics, the compositions herein must be formulated to also safely and effectively clean and refresh carpeting. In addition, the compositions herein comprise ingredients which are specially selected and formulated to minimize dye removal or migration from the stain site of fugitive, unfixed dye from the carpets being cleaned.

In addition to the foregoing considerations, the compositions used herein are preferably formulated such that they are easily dispensed and not so adhesive in nature that they render dispensing from the container to be unhandy or difficult. However, and while not intending to be limiting of the present invention, the preferred compositions disclosed herein afford a spot-cleaning process which is both effective and aesthetically pleasing when used in the manner disclosed herein.

(a) Bleach—The compositions herein may optionally comprise from about 0.25% to about 7%, by weight, of hydrogen peroxide. Preferred spot cleaners will comprise 0.5 to about 3% hydrogen peroxide. It will be appreciated that peroxide sources other than $H_2O_2$ can be used herein. Thus, various per-acids, per-salts, per-bleaches and the like known from the detergency art can be used. However, such materials are expensive, difficult to formulate in liquid products, can leave residues on fabrics and offer no special advantages over $H_2O_2$ when used in the present manner.

(b) Solvent—The compositions herein may comprise from about 0% to about 10%, by weight, of butoxy propoxy propanol (BPP) solvent or other solvents as disclosed herein. Preferred compositions will comprise 1–4% BPP.

(c) Water—The preferred, low residue compositions herein may comprise from about 90%, preferably from about 95.5% to about 99%, by weight, of water.

(d) Surfactant—The compositions herein may optionally comprise from about 0.05% to about 2%, by weight, of surfactants, such as MgAES and $NH_4$AES, amine oxides, ethoxylated alcohols or alkyl phenols, alkyl sulfates, and mixtures thereof. Typically, the weight ratio of BPP solvent:surfactant(s) is in the range of from about 10:1 to about 1:1. The most preferred composition comprises 2% BPP/0.3% MgAE(1)S/0.035% $C_{12}$ dimethyl amine oxide. Other preferred compositions include 2% BPP/0.25% Neodol 23 6.5, and 4% BPP/0.4% AS.

(e) Optionals—The compositions herein may comprise minor amounts of various optional ingredients, including bleach stabilizers, perfumes, preservatives, and the like. If used, such optional ingredients will typically comprise from about 0.05% to about 2%, by weight, of the compositions, having due regard for residues on carpeting.

(f) Chelator—Compositions which contain $H_2O_2$ will also typically contain a chelating agent. The chelating agent is selected from those which, themselves, are stable in aqueous $H_2O_2$ and which stabilize the $H_2O_2$ by chelating vagrant metal ions. Such chelating agents are typically already present at low, peroxide-stabilizing amounts (0.01–1%) in commercial sources of hydrogen peroxide. A variety of phosphonate chelators are known in stabilizing $H_2O_2$. The amino phosphonates are especially useful for this purpose. Various amino phosphonates are available as under the DEQUEST® trade name from the Monsanto Company, St. Louis, Mo. Representative, but non-limiting, examples include ethylenediamine tetrakis (methylene phosphonic) acid, diethylenetriamine penta(methylene phosphonic) acid, and the water-soluble salts thereof. Amino tris (methylene phosphonic) acid or its water-soluble salts (as DEQUEST 2000®) is a preferred chelator.

The pH range of the pre-spotting compositions helps provide stability to the hydrogen peroxide and is typically in the acid-slightly basic range from about 3 to about 8, preferably about 6.

Organic Solvent—The preferred cleaning (especially including spot cleaning) solvent herein is butoxy propoxy propanol (BPP) which is available in commercial quantities as a mixture of isomers in about equal amounts. The isomers, and mixtures thereof, are useful herein. The isomer structures are as follows:

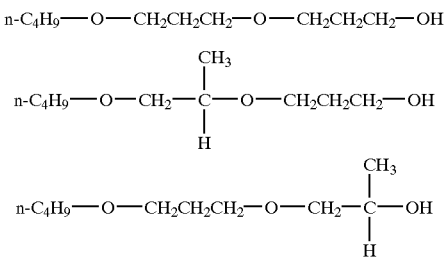

While the spot cleaning compositions herein function quite well with only the BPP, water and surfactant, they may also optionally contain other ingredients to further enhance their stability. Hydrotropes such as sodium toluene sulfonate and sodium cumene sulfonate, short-chain alcohols such as ethanol and isopropanol, and the like, can be present in the compositions. If used, such ingredients will typically comprise from about 0.05% to about 5%, by weight, of the stabilized compositions herein.

Surfactants—Nonionics such as the ethoxylated $C_{10}$–$C_{16}$ alcohols, e.g., NEODOL 23-6.5, can be used in the compositions. The alkyl sulfate surfactants which may be used herein as cleaners and to stabilize aqueous compositions are the $C_8$–$C_{18}$ primary ("AS"; preferred $C_{10}$–$C_{14}$, sodium salts), as well as branched-chain and random $C_{10}$–$C_{20}$ alkyl sulfates, and $C_{10}$–$C_{18}$ secondary (2,3) alkyl sulfates of the formula $CH_3(CH_2)_x(CHOSO_3^-M^+)$ $CH_3$ and $CH_3$ $(CH_2)_y$ $(CHOSO_3^-M^+)$ $CH_2CH_3$ where x and (y+1) are integers of at least about 7, preferably at least about 9, and M is a water-solubilizing cation, especially sodium, as well as unsaturated sulfates such as oleyl sulfate. Alkyl ethoxy sulfate (AES) surfactants used herein are conventionally depicted as having the formula $R(EO)_xSO_3Z$, wherein R is $C_{10}$–$C_{16}$ alkyl, EO is —$CH_2CH_2$—O—, x is 1–10 and can include mixtures which are conventionally reported as averages, e.g., $(EO)_{2.5}$, $(EO)_{6.5}$ and the like, and Z is a cation such as sodium ammonium or magnesium (MgAES). The $C_{12-C16}$ alkyl dimethyl amine oxide surfactants can also be used. A preferred mixture comprises $MgAE_1S/C_{12}$ dimethyl amine oxide at a weight ratio of about 10:1. Other surfactants which improve phase stability and which optionally can be used herein include the polyhydroxy fatty acid amides, e.g., $C_{12-C14}$ N-methyl glucamide. AS stabilized compositions preferably comprise 0.1%–0.5%, by weight, of the compositions herein. MgAES and amine oxides, if used, can comprise 0.01%–2%, by weight, of the compositions. The other surfactants can be used at similar levels.

Other Optionals—In addition to the water, the preferred BPP solvent, the optional $H_2O_2$ and the surfactants disclosed above, liquid compositions used herein may comprise various optional ingredients, such as perfumes, preservatives, brighteners, salts for viscosity control, pH adjusters or buffers, and the like. The following illustrates preferred ranges for cleaning compositions for use herein, but is not intended to be limiting thereof.

| Ingredient | % (wt.) Formula Range |
|---|---|
| BPP (Solvent) | 0.05–5 |
| Surfactant | 0–2 |
| Perfume | 0.01–1.5 |
| Water | Balance |
| pH range from about 6 to about 8. | |

Other solvents or co-solvents which can optionally be used herein include various glycol ethers, including materials marketed under trademarks such as Carbitol, methyl Carbitol, butyl Carbitol, propyl Carbitol, and hexyl Cellosolve, and especially methoxy propoxy propanol (MPP), ethoxy propoxy propanol (EPP), propoxy propoxy propanol (PPP), and all isomers and mixtures, respectively, of MPP, EPP, and BPP, as well as butoxy propanol (BP), and the like, and mixtures thereof. If used, such solvents or co-solvents will typically comprise from about 0.5% to about 2.5%, by weight, of the aqueous compositions herein. Non-aqueous (less than 50% water) compositions which optionally can be used in the pre-spotting step, can comprise the same solvents.

Absorbent Stain Receiver—The absorbent stain receiver which is used in the present invention includes an absorbent material which imbibes the liquid composition. In preferred modes of operation, the stain receiver is designed specifically to "wick" or "draw" the liquid compositions away from the stained area. The most preferred type of absorbent stain receiver for use herein comprises Functional Absorbent Materials ("FAM's") which are in the form of water-absorbent foams having a controlled capillary size. The physical structure and resulting high capillarity of FAM-type foams provide very effective water absorption, while at the same time the chemical composition of the FAM typically renders it highly lipophilic. Thus, the FAM can essentially provide both hydrophilicity and lipophilicity simultaneously. (FAM foams can be treated to render them hydrophilic. Both the hydrophobic or hydrophilic FAM can be used herein.)

The manufacture of FAM-type foams for use as the stain receiver herein forms no part of the present invention. The manufacture of FAM foam is very extensively described in the patent literature; see, for example: U.S. Pat. No. 5,260,345 to DesMarais, Stone, Thompson, Young, LaVon and Dyer, issued Nov. 9, 1993; U.S. Pat No. 5,268,224 to DesMarais, Stone, Thompson, Young, LaVon and Dyer, issued Dec. 7, 1993; U.S. Pat. No. 5,147,345 to Young, LaVon and Taylor, issued Sep. 15, 1992 and companion patent U.S. Pat. No. 5,318,554 issued Jun. 7, 1994; U.S. Pat. No. 5,149,720 to DesMarais, Dick and Shiveley, issued Sep. 22, 1992 and companion patents U.S. Pat. No. 5,198,472, issued Mar. 30, 1993 and U.S. Pat. No. 5,250,576 issued Oct. 5, 1993; U.S. Pat. No. 5,352,711 to DesMarais, issued Oct. 4, 1994; PCT application 93/04115 published Mar. 4, 1993, and U.S. Pat. No. 5,292,777 to DesMarais and Stone, issued Mar. 8, 1994; U.S. Pat. No. 5,387,207 to Dyer, DesMarais, LaVon, Stone, Taylor and Young, issued Feb. 7, 1995; U.S. Pat. No. 5,500,451 to Goldman and Scheibel, issued Mar. 19, 1996; and U.S. Pat. No. 5,550,167 to DesMarais, issued Aug. 27, 1996.

Alternatively, disposable paper towels, cloth towels such as BOUNTY™ brand towels, clean rags, etc., can be used. A preferred receiver consists of a nonwoven pad. In a preferred embodiment, the overall nonwoven is an absorbent structure composed of about 72% wood pulp and about 28% bicomponent staple fiber polyethylene-polypropylene (PE/

PP). It is about 60 mils thick. It optionally, but preferably, has a barrier film on its rear surface to prevent the cleaning liquid from passing onto the surface on which the pre-spotting operation is being conducted. The receiver's structure establishes a capillary gradient from its upper, fluid receiving layer to its lower layer. The gradient is achieved by controlling the density of the overall material and by layering the components such that there is lower capillary suction in the upper layer and greater capillary suction force within the lower layer. The lower capillary suction comes from having greater synthetic staple fiber content in the upper layer (these fibers have surfaces with higher contact angles, and correspondingly lower affinity for water, than wood pulp fibers) than in the lower layer.

More particularly, the absorbent stain receiver article herein can be conveniently manufactured using procedures known in the art for manufacturing nonwoven, thermally bonded air laid structures ("TBAL"). As an overall proposition, TBAL manufacturing processes typically comprise laying-down a web of absorbent fibers, such as relatively short (4–5 mm) wood pulp fibers, in which are commingled relatively long (30–50 mm) bi-component fibers which melt slightly with the application of heat to achieve thermal bonding. The bi-component fibers intermingled throughout the wood pulp fibers thereby act to "glue" the entire mat together. Different from conventional TBAL-type structures, the disposition of the bi-component fibers in the upper and lower layers of the stain receiver herein is not uniform. Rather, the upper (fluid receiving) layer of the fibers which comprises the stain receiver is relatively richer in bi-component fibers than in wood pulp (or other cellulosic) fibers. Since the bi-component fibers are made from synthetic polymers which are relatively hydrophobic, the upper layer of fibers in the stain receiver tends to be more hydrophobic, as compared with the lower layer of fibers which, since it contains a high proportion of wood pulp, tends to be more hydrophilic. This difference in hydrophobicity/hydrophilicity between the upper and lower fiber layers in the stain receiver helps draw water (e.g., the aqueous compositions herein) and stain materials out of the fabrics which are being treated in the manner disclosed herein.

To illustrate the foregoing in more detail, in one mode, the present stain receiver the uppermost (fluid receiving) layer (to be placed against the soiled carpeting) is about 50% bicomponent fiber and about 50% wood pulp, by weight, with a basis weight of about 50 grams/$m^2$ (gsm). The lower layer is an 80/20 (wt.) blend of wood pulp and bicomponent staple fiber with a basis weight of about 150 gsm. These ratios can be varied, as long as the upper layer is more hydrophobic than the lower layer. For example, upper layers of 60/40, 70/30, etc. bicomponent/wood can be used. Lower layers of 90/10, 65/35, 70/30, etc. wood/bicomponent can be used.

Lint Control Binder Spray—A heat crosslinkable latex binder can optionally be sprayed onto the upper layer of the stain receiver article to help control lint and to increase strength. A variety of alternative resins may be used for this purpose. Thus, the surface of the uppermost layer can be sprayed with a crosslinkable latex binder (Airflex 124, supplied by Air Products) at a concentration of about 3 to 6 grams per square meter. This binder does not have great affinity for water relative to wood pulp, and thus does not importantly affect the relative hydrophobicity of the upper layer. Cold or hot crimping, sonic bonding, heat bonding and/or stitching may also be used along all edges of the receiver to further reduce linting tendency.

Backing Sheet—When thus prepared, the bi-layer absorbent structure which comprises the stain receiver is sufficiently robust that it can be used as-is. However, in order to prevent strike-through of the liquid onto the table top or other treatment surface selected by the user, it is preferred to affix a fluid-impermeable barrier sheet to the bottom-most surface of the lower layer. This backing sheet also improves the integrity of the overall stain receiver article. The bottom-most surface of the lower layer can be extrusion coated with an 0.5–2.0 mil, preferably 0.75 mil, layer of PE or PP film using conventional procedures. The film layer is designed to be a pinhole-free barrier to prevent any undesired leakage of the liquid composition beyond the receiver. This backing sheet can be printed with usage instructions, embossed and/or decorated, according to the desires of the formulator. The stain receiver is intended for use outside the dryer. However, since the receiver may inadvertently be placed in the dryer and subjected to high temperatures, it is preferred that the backing sheet be made of a heat resistant film such as polypropylene or nylon.

Basis weight—This can vary depending on the amount of cleaning/refreshment solution provided/anticipated to be absorbed. The preferred stain receiver structure exhibits a horizontal absorbency of about 4–15 grams of water for every gram of nonwoven. A typical 90 mm×140 mm receiver absorbs about 10–20 grams of water. Since very little fluid is used in the typical stain removal process, much less capacity is actually required. A practical range is therefore about 10 g. to about 50 g.

Size—The size of the preferred receiver is about 90 mm by 140 mm, but other sizes can be used. The shape can be varied.

Fibers—Conveniently available 2–3 denier (0.0075–0.021 mm) polyethylene/polypropylene PE/PP bicomponent staple and standard wood pulp (hammermilled) fibers are used in constructing the preferred receiver. Other common staple fibers such as polyester, acrylic, nylon, and bicomponents of these can be employed as the synthetic component. Again, capillary suction requirements need to be considered when selecting these fibers and their sizes or deniers. Larger denier detracts from capillary suction as does surface hydrophobicity. The absorbent wood pulp fiber can also be substituted with cotton, hemp, rayon, and others. If desired, the lower layer can also comprise the so-called "supersorber" absorbent gelling materials (AGM) which are known for use in the diaper and catamenial arts. Such AGM's can comprise 1% to 20%, by weight, of the lower layer.

Thickness—The overall thickness (measured unrestrained) of the stain receiver is about 60 mils, but can be varied widely. The low end may be limited by the desire to provide absorbency impression. 25 mils to 200 mils (0.6 mm–5.1 mm) is a reasonable range.

Capillary suction/density—The overall density of the stain receiver affects both absorbency rate and fluid capacity. Typical wood pulp containing absorbent articles have a density (measured unrestrained) that ranges around 0.12–0.15 g/cc +/−0.05. The preferred bi-layer stain receiver herein also has a density in the same range, but can be adjusted outside this range. Higher density increases stiffness; lower density decreases overall strength and makes Tinting more probable. The capillary suction is determined by the type of fibers, the size of the fibers, and the density of the structure. Fabrics come in many varieties, and will exhibit a large range of capillary suction, themselves. It is desirable to construct a receiver that has a greater surface capillary suction than that of the stained carpet being treated.

Colors—White is the preferred color, as it will best show stains as they are being removed from the fabrics being treated. However, there is no other functional limit to the color.

Embossing—The preferred stain receiver structure is embossable with any desired pattern or logo.

Optional Nonwoven (NW) types—While the TBAL stain receiver structure is preferred to permit density control, good thickness perception, good absorbency, and good resiliency, other types of NWs that can reasonably be used are hydroentangled, carded thermal, calendar-bonded, and other good wipe substrate-making processes (including thermal bonded wet-laid, and others).

Manufacture—The manufacture of the preferred bi-layer stain receiver is conducted using conventional TBAL processes. In one mode, the lower wood fiber-rich layer is first laid-down and the upper, synthetic fiber-rich layer is laid-down on top of it. The optional binder spray is applied to the upper layer at any convenient time. The resulting bi-layer structure is collected in rolls (which compacts the overall structure somewhat). Overall, the bi-layer structure (unrestrained) has a thickness of about 60 mils and a density of about 0.13–0.15 g/cc. This density may vary slightly, depending on the usage rates of the binder spray. The optional backing sheet is applied by passing the structure in sheet form through nip-rollers, together with a sheet of the backing film. Again, conventional procedures are used. If desired, and as a cost savings, the relative thicknesses of the lower and upper layers can be varied. Thus, since wood pulp is less expensive than bi-component fibers, the manufacturer may decide to lay down a relatively thicker lower layer, and a relatively thinner upper layer. Thus, rather than a structure whose upper/lower layer thickness ratio is about 1:1, one can select ranges of 0.2:1, 0.3:1, 0.5:1, and the like. If more absorbency is required, the ratios can be reversed. Such considerations are within the discretion of the manufacturer.

The bi-layer stain receiver is intended to be made so inexpensively that it can be discarded after a single use. However, the structures are sufficiently robust that multiple re-uses are possible. In any event, the user should position the article such that "clean" areas are positioned under the stained areas of the carpet being treated in order to avoid release of old stains from the stain receiver back onto the carpet.

The following Examples further illustrate the present invention, but are not intended to be limiting thereof.

EXAMPLE I

A liquid cleaning composition for use herein with a FAM-foam absorbent stain receiver and an ultrasonic wave generating source is as follows.

| INGREDIENT | Wt. (%) |
|---|---|
| Butoxypropoxypropanol (BPP) | 2.000 |
| $NH_4$ Coconut $E_1S$ | 0.285 |
| Dodecyldimethylamine oxide | 0.031 |
| $MgCl_2$ | 0.018 |
| $MgSO_4$ | 0.019 |
| Hydrotrope, perfume, other minors, | 0.101 |
| Kathon preservative | 0.0003 |
| Water | 97.547 |
| pH target = 7; range = 6–8 | |

A Teldyne WaterPik torsional sonic toothbrush is modified by truncating the brushes at the distal head and hand smoothing the resulting stump into a smooth rounded tip, thereby resulting in an ultrasonic wave generating source in the form of a "sonic pen" which can be hand-held according to the invention. Optionally, the "sonic pen" can be modified to include the liquid composition in a housing encased around the "sonic pen" with a valve mechanism for controlled delivery of the composition. The acquisition and absorbency of the FAM-foam absorbent stain receiver with respect to the liquid cleaning composition herein is superior to most other types of absorbent materials. For example, the FAM has a capacity of about 6 g ($H_2O$) per gram of foam at a suction pressure of 100 cm of water. By contrast, cellulose wood fiber structures have substantially no capacity above about 80 cm of water. Since, in typical modes of operation of the invention, the volume of liquid composition used is relatively low (a few milliliters is typical), the amount of FAM used can be small. This means that the pad of FAM which underlays the stained area of fabric can be quite thin and still be effective. However, if too thin, the pad may tend to crumble, in-use. (As noted above, a backing sheet can be applied to the FAM to help maintain its integrity.) Absorbent stain receiver pads made of FAM foam can be used in either of two ways. In one mode, the uncompressed foam is used. Uncompressed FAM pads having a thickness in the range of about 0.3 mm to about 15 mm are useful. In another mode, the FAM foam can be used in a compressed state which swells as the liquid composition with its load of stain material is imbibed. Compressed FAM foams having thicknesses in the range of about 0.02 inches (0.5 mm) to about 0.135 inches (3.4 mm) are suitable herein.

The liquid composition is applied to the stain on the textile, after which the "sonic pen" is used to impart ultrasonic waves to the stain for about 45 seconds. Thereafter, the FAM foam stain receiver is applied to the wet, "ultrasoniced" stain with pressure applied in the z direction. The stain is wicked or otherwise sucked into the FAM foam stain receiver leaving the previously stained textile substantially with its original appearance.

EXAMPLE II

In another exemplary operation of the invention, the FAM foam absorbent stain receiver is packaged with the liquid cleaning composition imbibed in the receiver with a backing sheet for support. The user removes the absorbent stain receiver from the packaging and applies the exposed side (i.e., non-backing sheet side) underneath and against the stain. The "sonic pen" is then used to impart ultrasonic waves and pressure in the z direction against the stain. The downward force in the z direction squeezes the liquid composition out from the FAM foam stain receiver into the stain while the "sonic pen" simultaneously imparts ultrasonic waves effectuating cleaning of the stain. The compressed FAM foam stain receiver rebounds drawing, wicking or otherwise sucking the fluid and stain back into the FAM foam stain receiver. The cleaning of the stain including liquid cleaning composition penetration and ultrasonic wave exposure is localized with minimal effects on non-stained portions of the textile.

EXAMPLE III

The preparation of FAM foam (also sometimes referred to in the literature as "HIPE", i.e., high internal phase emulsion) is described in the patents cited hereinabove. The following illustrates the preparation of a compressed foam for use herein having a thickness of about 0.025 inches (0.063 cm). Such compressed foams in the 0.025 in.–0.027 in. (0.063 cm–0.068 cm) range are especially useful as the stain receiver herein.

Preparation of Emulsion and FAM Foams Therefrom

A) Emulsion Preparation Anhydrous calcium chloride (36.32 kg) and potassium persulfate (189 g) are dissolved in 378 liters of water. This provides the water phase stream to be used in a continuous process for forming the emulsion.

To a monomer combination comprising distilled divinylbenzene (42.4% divinylbenzene and 57.6% ethyl styrene) (1980 g), 2-ethylhexyl acrylate (3300 g), and hexanedioldiacrylate (720 g) is added a diglycerol monooleate emulsifier (360 g), ditallow dimethyl ammonium methyl sulfate (60 g), and Tinuvin 765 (15 g). The diglycerol monooleate emulsifier (Grindsted Products; Brabrand, Denmark) comprises approximately 81% diglycerol monooleate, 1% other diglycerol monoesters, 3% polyols, and 15% other polyglycerol esters, imparts a minimum oil/water interfacial tension value of approximately 2.7 dyne/cm and has an oil/water critical aggregation concentration of approximately 2.8 wt. %. After mixing, this combination of materials is allowed to settle overnight. No visible residue is formed and all of the mixture is withdrawn and used as the oil phase in a continuous process for forming the emulsion.

Separate streams of the oil phase (25° C.) and water phase (53–55° C.) are fed to a dynamic mixing apparatus. Thorough mixing of the combined streams in the dynamic mixing apparatus is achieved by means of a pin impeller. The pin impeller comprises a cylindrical shaft of about 36.8 cm in length with a diameter of about 2.5 cm. The shaft holds 6 rows of pins, 3 rows having 33 pins and 3 rows having 32 pins, each having a diameter of 0.5 cm extending outwardly from the central axis of the shaft to a length of 2.5 cm. The pin impeller is mounted in a cylindrical sleeve which forms the dynamic mixing apparatus, and the pins have a clearance of 1.5 mm from the walls of the cylindrical sleeve.

A minor portion of the effluent exiting the dynamic mixing apparatus is withdrawn and enters a recirculation zone; see PCT U.S. Pat. No. 96/00082 published Jul. 18, 1996 and EPO 96/905110.1 filed Jan. 11, 1996. The Waukesha pump in the recirculation zone returns the minor portion to the entry point of the oil and water phase flow streams to the dynamic mixing zone.

The combined mixing and recirculation apparatus set-up is filled with oil phase and water phase at a ratio of 4 parts water to 1 part oil. The dynamic mixing apparatus is vented to allow air to escape while filling the apparatus completely. The flow rates during filling are 7.6 g/sec oil phase and 30.3 cc/sec water phase.

Once the apparatus set-up is filled the vent is closed. Agitation is then begun in the dynamic mixer, with the impeller turning at 1450 RPM and recirculation is begun at a rate of about 30 cc/sec. The flow rate of the water phase is then steadily increased to a rate of 151 cc/sec over a time period of about 1 min., and the oil phase flow rate is reduced to 3 g/sec over a time period of about 3 min. The recirculation rate is steadily increased to about 150 cc/sec during the latter time period. The back pressure created by the dynamic mixer and static mixing zone (TAH Industries Model Number 101–212) at this point is about 14.7 PSI (101.4 kPa), which represents the total back pressure of the system. The Waukesha pump speed is then steadily decreased to a yield a recirculation rate of about 75 cc/sec. The impeller speed in then steadily increased to 1550 RPM over a period of about 10 seconds. The back pressure increases to about 16.3 PSI (112 kPa).

B) Polymerization of Emulsion

The emulsion flowing from the static mixer is collected in a round polypropylene tub, 17 in. (43 cm) in diameter and 7.5 in (10 cm) high, with a concentric insert made of Celcon plastic. The insert is 5 in (12.7 cm) in diameter at its base and 4.75 in (12 cm) in diameter at its top and is 6.75 in (17.1 cm) high. The emulsion-containing tubs are kept in a room maintained at 65 ° C. for 18 hours to bring about polymerization and form the foam.

C) Foam Washing and Dewatering

The cured FAM foam is removed from the curing tubs. The foam at this point has residual water phase (containing dissolved emulsifiers, electrolyte, initiator residues, and initiator) about 45–55 times (45–55×) the weight of polymerized monomers. The foam is sliced with a sharp reciprocating saw blade into sheets which are 0.185 inches (0.47 cm) in thickness. These sheets are then subjected to compression in a series of 2 porous nip rolls equipped with vacuum which gradually reduce the residual water phase content of the foam to about 6 times (6×) the weight of the polymerized material. At this point, the sheets are then resaturated with a 1.5% $CaCl_2$ solution at 60° C., are squeezed in a series of 3 porous nip rolls equipped with vacuum to a water phase content of about 4×. The $CaCl_2$ content of the foam is between 8 and 10%.

The foam remains compressed after the final nip at a thickness of about 0.025 in. (0.063 cm). The foam is then dried in air for about 16 hours. Such drying reduces the moisture content to about 9–17% by weight of polymerized material. At this point, the foam sheets are very drapeable. In this collapsed state, the density of the foam is about 0.14 g/cc.

EXAMPLE IV

Examples of preferred, high water content, low residue compositions for use herein are as follows. The compositions are listed as "nonionic" or "anionic", depending on the type of surfactant used therein. These compositions are used in the manner disclosed herein to spot-clean carpeting.

| INGREDIENT | Nonionic Comp. (%) | Anionic Comp. (%) |
|---|---|---|
| Hydrogen peroxide | 1.000 | 1.000 |
| Amino tris (methylene phosphonic acid)* | 0.040 | 0.0400 |
| Butoxypropoxypropanol (BPP) | 2.000 | 2.000 |
| Neodol 23 6.5 | 0.250 | — |
| $NH_4$ Coconut $E_1S$ | — | 0.285 |
| Dodecyldimethylamine oxide | — | 0.031 |
| Magnesium chloride | — | 0.018 |
| Magnesium sulfate | — | 0.019 |
| Hydrotrope, perfume, other minors, | — | 0.101 |
| Kathon preservative | 0.0003 | 0.0003 |
| Water (deionized or distilled) | 96.710 | 96.507 |
| Target pH** | 6.0 | 6.0 |

*Stabilizer for hydrogen peroxide
**Range pH 6–8

Preferably, to minimize the potential for dye damage as disclosed hereinabove, such compositions comprise the anionic or nonionic surfactant in an amount (by weight of composition) which is less than the amount of $H_2O_2$. Preferably, the weight ratio of surfactant:$H_2O_2$ is in the range of about 1:10 to about 1:1.5, most preferably about 1:4 to about 1:3.

EXAMPLE V

A liquid pre-spotting cleaning composition is formulated by admixing the following ingredients.

| Ingredient | % (wt.) |
|---|---|
| BPP | 4.0 |
| $C_{12}$–$C_{14}$ AS, Na salt | 0.25 |
| $H_2O_2$ | 1.0 |
| Water and minors* | Balance |

*Includes preservatives such as KATHON ® at levels of 0.00001%–1%, by weight.

Other useful compositions which can be used in this manner are as follows:

| Ingredient | Percent wt. | (Range; wt.) |
|---|---|---|
| BPP | 4.0 | 0.1–4.0% |
| $C_{12}$–$C_{14}$ AS | 0.4 | 0.1–0.5% |
| Nonionic Surfactant (optional)* | 0.1 | 0–0.5% |
| $H_2O_2$ | 0.25 | 0.25–7.0 |
| Water (distilled or deionized) | Balance | 95–99.8% |
| Target pH = 5.0–7.0, preferably 6.0. | | |

*The optional nonionic surfactants in the compositions herein are preferably $C_{12}$–$C_{14}$ N-methyl glucamides or ethoxylated $C_{12}$–$C_{16}$ alcohols (EO 1–10).

EXAMPLE VI

Another preferred liquid composition for use herein is as follows.

| INGREDIENT | % (Wt.) |
|---|---|
| Hydrogen peroxide | 1.000 |
| Amino tris (methylene phosphonic acid)* | 0.040 |
| Butoxypropoxypropanol (BPP) | 2.000 |
| Neodol 23 6.5 (Nonionic) | 0.250 |
| Kathon preservative | 0.0003 |
| Water | 96.710 |
| pH target = 7; range = 6–8 | |

*Stabilizer for hydrogen peroxide

Having thus described the invention in detail, it will be obvious to those skilled in the art that various changes may be made without departing from the scope of the invention and the invention is not to be considered limited to what is described in the specification.

What is claimed is:

1. A carpet stain removal kit comprising:

(a) a liquid cleaning composition including water, an organic solvent and a surfactant;

(b) an absorbent stain receiver comprised of an absorbent material;

(c) a sonic or ultrasonic wave generating source for imparting sonic or ultrasonic waves onto stains on textiles wherein said sonic or ultrasonic wave generating source is a battery operated pen-shaped, hand-held ultrasonic vibrational device with a vibrating smooth rounded sonic horn or tip at one distal end of said device such that said ultrasonic waves are focused at the stain to be removed, wherein said liquid cleaning composition and said sonic or ultrasonic wave generating source are contained together in said device that permits controlled dispensing of said liquid cleaning composition to the stain while concurrently imparting sonic or ultrasonic waves thereto; and (d) a set of instructions for using said kit comprising the steps of:

(i) applying an effective amount of said liquid cleaning composition to said stain;

(ii) imparting sonic or ultrasonic waves to said stain using said sonic or ultrasonic source; and (iii) contacting said absorbent stain receiver with said stain while applying pressure so as to absorb said stain into said absorbent material of said absorbent stain receiver.

2. The carpet stain removal kit of claim 1 wherein said solvent is butoxy propoxy propanol.

3. The carpet stain removal kit of claim 1 wherein said absorbent material is selected from the group consisting of comminuted wood pulp, creped cellulose wadding, hydrogel-forming polymer gelling agents, creped tissues, creped nonwovens containing fibers comprised of absorbent polymers, modified cross-linked cellulose fibers, capillary channel fibers, absorbent foams, thermally bonded airlaid materials, absorbent sponges, synthetic staple fibers, polymeric fibers, peat moss, and combinations thereof.

4. The carpet stain removal kit of claim 1 wherein said surfactant is selected from the group consisting of anionic surfactants, nonionic surfactants, cationic surfactants and mixtures thereof.

5. A process for removing a stain from carpeting, said process comprising the steps of:

(a) applying an effective amount of a liquid cleaning composition to said stain;

(b) imparting sonic or ultrasonic waves to said stain with a sonic or ultrasonic source wherein said sonic or ultrasonic source wave generating source is a battery operated pen-shaped, hand-held ultrasonic vibrational device with a vibrating smooth rounded sonic horn or tip at one distal end of said device such that said ultrasonic waves are focused at the stain to be removed, wherein said liquid cleaning composition and said sonic or ultrasonic wave generating source are contained together in said device that permits controlled dispensing of said liquid cleaning composition to the stain while concurrently imparting sonic or ultrasonic waves thereto; and (c) contacting said stain with an absorbent stain receiver having an absorbent material while applying pressure so as to absorb said stain into said absorbent material of said absorbent stain receiver.

6. The process of claim 5 wherein said liquid cleaning composition comprises water, an organic solvent and a surfactant.

7. The process of claim 5 wherein said solvent is butoxy propoxy propanol.

8. The process of claim 5 wherein said absorbent material is selected from the group consisting of comminuted wood pulp, creped cellulose wadding, hydrogel-forming polymer gelling agents, creped tissues, creped nonwovens containing fibers comprised of absorbent polymers, modified cross-linked cellulose fibers, capillary channel fibers, absorbent foams, thermally bonded airlaid materials, absorbent sponges, synthetic staple fibers, polymeric fibers, peat moss, and combinations thereof.

9. The process of claim 5 wherein said steps (a) and (b) are conducted simultaneously using a device that permits controlled dispensing of said liquid cleaning composition to the stain while concurrently imparting sonic or ultrasonic waves thereto.

10. The process of claim 5 wherein said liquid cleaning composition includes:

(i) from 0.1% to 10% by weight of an organic solvent;

(ii) from 0% to 7% by weight of hydrogen peroxide;

(iii) from 0% to 3% by weight of a peroxide-stabilizing amount of a chelating agent;

(iv) from 0.05% to 2% by weight of a detersive surfactant; and (v) the balance water and other optional ingredients.

11. A process for removing a stain from carpeting, said process comprising the steps of:

(i) using a device to apply an effective amount of a liquid cleaning composition to said stain concurrently with sonic or ultrasonic waves from a sonic or ultrasonic source, wherein said sonic or ultrasonic source and said liquid cleaning composition are embodied in said device and wherein said sonic or ultrasonic source is a battery operated pen-shaped, hand-held ultrasonic vibrational device with a vibrating smooth rounded sonic horn or tip at one distal end of said device such that said ultrasonic waves are focused at the stain to be removed; and (ii) contacting an absorbent stain receiver having an absorbent material with said stain while applying pressure so as to absorb said stain into said absorbent material of said absorbent stain receiver.

12. The carpet stain removal kit of claim 1 wherein the set of instructions further comprise the step of applying an effective amount of said liquid cleaning composition to said stain for a period of between about 1 second and about 5 minutes.

* * * * *